US005706833A

United States Patent [19]

Tsugaya et al.

[11] Patent Number: 5,706,833

[45] Date of Patent: Jan. 13, 1998

[54] TOBACCO FILTERS AND METHOD OF PRODUCING THE SAME

[75] Inventors: Hitoshi Tsugaya, Kawachinagano; Hiroki Taniguchi, Himeji; Nobuyuki Oji, Sakai; Kanae Nishimura, Himeji, all of Japan

[73] Assignees: Daicel Chemical Industries, Ltd., Sakai; Japan Tobacco, Inc., Tokyo, both of Japan

[21] Appl. No.: 273,751

[22] Filed: Jul. 12, 1994

[30] Foreign Application Priority Data

Jul. 13, 1993 [JP] Japan ..... 5-196857

[51] Int. Cl.[6] ..... A24D 3/00; A24D 3/02; A24D 3/06; A24D 3/10

[52] U.S. Cl. ..... 131/332; 131/342; 131/343; 131/345

[58] Field of Search ..... 131/88, 332, 342, 131/343, 345

[56] References Cited

U.S. PATENT DOCUMENTS

| | | | |
|---|---|---|---|
| 3,365,346 | 1/1968 | Fritz et al. | |
| 3,583,406 | 6/1971 | Soyars et al. | 131/79 |
| 4,022,740 | 5/1977 | Morie et al. | 524/603 |
| 4,221,226 | 9/1980 | Kiefer et al. | 131/343 |
| 5,063,945 | 11/1991 | Sugihara et al. | 131/332 |
| 5,439,010 | 8/1995 | Ross | 428/537.5 |
| 5,453,144 | 9/1995 | Kauffman | 156/213 |
| 5,498,224 | 3/1996 | Kauffman | 493/39 |
| 5,591,297 | 1/1997 | Ahr | 156/521 |

FOREIGN PATENT DOCUMENTS

| | | |
|---|---|---|
| 656697 | 4/1965 | Belgium . |
| A10027740 | 4/1981 | European Pat. Off. . |
| 1149156 | 12/1955 | France . |
| 2368904 | 5/1978 | France . |
| 50-75223 | 6/1975 | Japan . |
| 56-24151 | 3/1981 | Japan . |
| 757283 | 9/1956 | United Kingdom . |
| 9324685 | 12/1993 | WIPO . |

OTHER PUBLICATIONS

Nakatsuka et al., CA Abstract 78:121,618, abstracting DE 2140346 (1973).

*Primary Examiner*—Jeffrey C. Mullis

*Attorney, Agent, or Firm*—Cushman, Darby & Cushman IP Group of Pillsbury, Madison & Sutro LLP

[57] ABSTRACT

A filter rod is produced by adding a water-soluble polymer in the form of an aqueous solution or dispersion, or in a particulate form, to a tow of cellulose ester fiber, with the amount of any water used being controlled within 25 parts by weight relative to 100 parts by weight of the tow, and wrapping the treated tow in wrapping paper. The water contained in the filter rod is removed or the particulate water-soluble polymer is melted by heating to bond the fiber to provide a tobacco filter. The proportion of the water-soluble polymer is 0.5 to 30 parts by weight to 100 parts by weight of the tow. To reduce the amount of water relative to the tow, a hot-melt adhesive water-soluble polymer may be employed. As the amount of water added to the tow is thus decreased, the tow can be smoothly wrapped up even at a high speed so that filter productivity is improved. This tobacco filter is highly wet-disintegratable and, hence, contributes to mitigation of the environmental pollution.

3 Claims, No Drawings

TOBACCO FILTERS AND METHOD OF PRODUCING THE SAME

FIELD OF THE INVENTION

This invention relates to a tobacco filter which, if discarded into the environment after smoking, is readily disintegrated or dispersed by rain water or the like.

BACKGROUND OF THE INVENTION

The tobacco filter comprising a tow of cellulose ester fiber is in broad use for the purpose of removing the tars from tobacco smoke and yet preserving or keeping the taste and palatability of the smoke. In the production of such a tobacco filter, a plasticizer (e.g. triacetin, triethylene glycol diacetate, triethylene glycol dipropionate, dibutyl phthalate, dimethoxyethyl phthalate, triethyl citrate, etc.) is commonly added for shape retention of the filter plug and for insuring the firmness or hardness necessary for cutting out filter tips from the plug.

In the filter plug formed with the aid of such a plasticizer, the filaments have been partly fused together by the plasticizer. Thus, the plasticizer plays the role of a binder interbonding the cellulose ester filaments at random locations. As a consequence, if the cigaret butt is discarded, it takes a long time for the filter plug to disintegrate itself, doing aesthetic harm to the environment and adding to the pollution problem.

Meanwhile, a paper filter made from creped wood pulp and a tobacco filter comprising a tow of regenerated cellulose fiber are also known. Compared with a filter comprising a tow of cellulose ester fiber, these filters are slightly more wet-disintegratable and, hence, of somewhat lower pollution potential. However, the aroma and palatability of tobacco smoke are sacrificed and the selective removal of phenolic components which is required of any tobacco filter can hardly be expected. Moreover, the firmness of these filters is lower than that of the cellulose ester filter on a given pressure loss basis.

Japanese Patent Application Laid-open No. 24151/1981 (JP-A-56-24151) discloses a filter comprising a cellulose acetate fiber and a hot-melt or temperature-sensitive adhesive fiber bonding said acetate fiber at points of intersection. As the hot-melt adhesive fiber, a fibrillated polyolefin or equivalent fiber is employed and its proportion to cellulose acetate fiber is 25–50 weight %. This filter is substantially not disintegrated in water because the cellulose acetate fiber is three-dimensionally or nodally bonded at a multiplicity of points of intersection by the water-insoluble hot-melt adhesive fiber.

Japanese Patent Laid-open No. 75223/1975 (JP-A-50-75223) corresponding to U.S. patent application Ser. No. 411,117 describes a technology for manufacturing a tobacco filter which comprises bonding a cellulose ester fiber with an adhesive composition consisting of a high-boiling polyol and a water-soluble or -dispersible polymer which is soluble in said polyol as selected from the group consisting of polyesters, polyamides and polyesteramides.

WO 93/24685, directed to a biodegradable tobacco filter comprising a cellulose ester fiber and a photo-sensitive metal oxide, describes a filter rod (tobacco filter) comprising a tow of the fiber integrated with a water-soluble binder and a water-soluble adhesive for fixing or adhering a wrapping paper which wraps the tow.

As described in these literature, a water-soluble adhesive agent in the form of a solution in water or a hydrophilic solvent is applied to the fiber by spraying or dipping but there is no reference to importance of the amount of water used with respect to the cellulose ester fiber.

Meanwhile, a filter rod is generally manufactured by wrapping a tow of cellulose ester or other fiber in wrapping paper at a high speed of, for example, about 400 m/min. Therefore, in the manufacture of a filter rod, the tow should be compatible with the high speed of processing, particularly that of wrapping operation.

SUMMARY OF THE INVENTION

It is, therefore, an object of this invention to provide a tobacco filter which is highly wet-disintegratable and, hence, contributory to mitigation of the pollution problem and a method of producing the same.

It is a further object of this invention to provide a tobacco filter which is readily disintegrated or dispersed by water such as rain water and, even if discarded into the environment after smoking, will not do aesthetic harm to the environment and a method for manufacturing the same.

It is a still further object of this invention to provide a tobacco filter which provides for an adequate effortless puff volume or resistance to draw and does not detract from the aroma, taste and palatability of tobacco smoke and a method for manufacturing the same.

It is still another object of this invention to provide a method for increasing the productivity of tobacco filters by which a tow of cellulose ester fiber can be wrapped smoothly at a high speed despite the use of a water-soluble polymer.

The inventors of this invention found after a great deal of research done to accomplish the above-mentioned objects that a tobacco filter manufactured from a tow of cellulose ester fiber employing a water-soluble polymer in lieu of the conventional plasticizer for cellulose ester fiber disintegrates itself rapidly on contact with water and that the amount of water used with respect to the tow of cellulose ester fiber has a profound influence on the productivity of filters. This invention has been developed and completed on the basis of the above findings.

Thus, the tobacco filter of this invention is a filter comprising a tow of cellulose ester fiber and a water-soluble polymer contained in the tow and bonding the fiber as formed into the shape of a rod using not more than 25 parts by weight of water with respect to 100 parts by weight of the tow. The proportion of the water-soluble polymer relative to 100 parts by weight of the tow may for example be about 0.5 to 30 parts by weight. The water-soluble polymer include polymers having a melting point of about 50° to 200° C. The water-soluble polymer can be used in a liquid form, such as a solution or a dispersion, or in a particulate form. To reduce the required amount of water relative to the tow, the water-soluble polymer may be a hot-melt adhesive polymer. The hot-melt adhesive polymer means a temperature-sensitive adhesive polymer which is solid at room temperature and develops adhesive power by cooling a molten or melt polymer applied to an adherent.

The tobacco filter of this invention may be manufactured by a step comprising adding the water-soluble polymer in the form of an aqueous solution or dispersion or in a particulate form to a tow of cellulose ester fiber and a step comprising processing the tow into a filter rod. Where the water-soluble polymer is used in the form of an aqueous solution or dispersion, the filter rod can be manufactured at a high speed by reducing the amount of water to be added with respect to the tow. The relative amount of water can be reduced by applying the water-soluble polymer in the form of a solution or dispersion to a previously opened or spread-out tow. The low-boiling solvent and water are removed from the filter rod afterwards. Where the water-soluble polymer is used in a particulate form, the cellulose ester fiber can be bonded by melting and cooling the polymer. By these technical innovations, the tow can be successfully wrapped in wrapping paper at high speed.

In some cases, a polymer does not show a distinct melting point but softens at a specific temperature. In this specification, the term "melting point" as used herein includes, within the meaning thereof, the softening point of such polymer as well.

DETAILED DESCRIPTION OF THE INVENTION

The cellulose ester mentioned above includes, for example, organic acid esters such as cellulose acetate, cellulose butyrate, cellulose propionate, etc.; inorganic acid esters such as cellulose nitrate, cellulose sulfate, cellulose phosphate, etc.; mixed acid esters such as cellulose acetate propionate, cellulose acetate butyrate, cellulose acetate phthalate, cellulose nitrate acetate, etc.; and cellulose ester derivatives such as polycaprolactone-grafted cellulose acetate and so on. These cellulose esters can be used alone or in combination.

The average degree of polymerization of the cellulose ester may for example be about 10 to 1,000, preferably about 50 to 900 and more preferably about 200 to –800. The average substitution degree of the cellulose ester may for example be about 1 to 3. Cellulose esters with average substitution degrees in the range of about 1 to 2.15, preferably about 1.1 to 2.0, are useful for promoting biodegradation.

The preferred cellulose ester includes organic acid esters (e.g. esters with organic acids having about 2 to 4 carbon atoms), among which cellulose acetate is particularly desirable. While the degree of acetylation of cellulose acetate is generally within the range of about 43% to 62%, those species with degrees of acetylation in the range of about 30 to 50% are highly biodegradable. Therefore, the degree of acetylation of the cellulose acetate can be selected from the range of about 30 to 62%.

The cellulose ester fiber mentioned above may contain a variety of additives such as finely divided powders of inorganic substances, e.g. kaolin, talc, diatomaceous earth, quartz, calcium carbonate, barium sulfate, titanium dioxide, alumina, etc., thermal stabilizers, e.g. salts of alkaline earth metals such as calcium, magnesium, etc., colorants, oils and yield improvers. Furthermore, the environmental degradability of the fiber can be increased by incorporating a biodegradation accelerator such as citric acid, tartaric acid, malic acid, etc. and/or a photodegradation accelerator such as anatase-form titanium dioxide.

The cellulose ester fiber may practically contain a whitening agent such as titanium dioxide, preferably anatase-form titanium dioxide. The average particle size of titanium dioxide is, for example, about 0.1 to 10 μm and preferably about 0.2 to 5 μm. The proportion of titanium dioxide to the whole cellulose ester is generally about 0.05 to 2.0 weight %, preferably about 0.1 to 1 weight %, more preferably about 0.2 to 0.8 weight %, and practically in the range of about 0.4 to 0.6 weight %.

The fineness of cellulose ester fiber is about 1 to 16 deniers, preferably about 1 to 10 deniers, and more preferably about 2 to 8 deniers. The cellulose acetate fiber may be non-crimped but is preferably a crimped fiber. The degree of crimping for crimped fiber may for example be about 5 to 75 crimps per linear inch, preferably 10 to 50 per inch, and more preferably about 15 to 50 per inch. The degree of crimping in many instances is about 20 to 50 crimps per inch. Moreover, a uniformly crimped fiber is more often employed. With a crimped fiber, a filter rod with an adequate degree of puff resistance and inhibited channelling can be obtained. Moreover, the fibers can be effectively bonded even with a reduced amount of the water-soluble polymer.

The cross-sectional configuration of cellulose ester fiber is not particularly restricted but may for example be circular, elliptical or any other configuration. Thus, the fiber may be of modified cross-section (e.g. Y-, X-, I- or R-configured) or hollow.

The tow (fiber bundle) of cellulose ester fiber can be obtained by bundling about 3,000 to 1,000,000, monofilaments, preferably about 5,000 to 100,000 monofilaments, of cellulose ester fiber. Practically, about 3,000 to 100,000 continuous monofilaments are bundled.

The term "water-soluble polymer" is used in this specification to include water-dispersible polymers in its broad sense. The water-soluble polymer (water-soluble adhesive) can be used in a liquid form, e.g. an aqueous solution or dispersion, or in a solid form, e.g. powder, or even in the form of a melt. The type of water-soluble polymer is not particularly restricted bug may for example be a natural polymer, a semi-synthetic polymer or a synthetic polymer. Such water-soluble polymers can be used singly or in combination.

The natural polymer includes, among others, various polysaccharides (e.g. starches such as wheat starch, corn starch, potato starch, tapioca starch, sweet potato starch, etc., mannans such as konjak mannan, yeast mannan, etc., water-soluble polymers of the seaweed origin such as funori, agar, alginic acid salts, e.g. sodium alginate, carrageenin, etc., mucilagenous substances of the vegetable origin such as tragacanth gum, gum arabic, hibiscus, locust bean gum, guar gum, pectin, etc., and mucilagenous substances of the microbial origin such as dextran), and animal and plant proteins (e.g. glue, gelatin, casein, collagen, hyaluronic acid, etc.).

The semi-synthetic polymer includes, for instance, various cellulose derivatives such as carboxymehylcellulose and its salt (e.g. carboxymethylcellulose sodium), hydroxyethylcellulose, hydroxypropylcellulose, cellulose acetate with an average degree of acetylation within the range of about 0.3 to 1, methylcellulose, ethylcellulose, cellulose sulfate, etc., modified starches and starch derivatives (e.g. solubilized starch, pregelationized starch, etc.), dextrin and roast dextrin, oxidized starches such as dialdehyde starch etc., thin boiling starch, starch ethers such as carboxymethylether starch, starch esters, crosslinked starches and so on.

The synthetic polymer includes, for example, water-soluble vinyl polymers such as polyvinyl alcohol, polyvinylpyrrolidone, polyvinyl ether, copolymers of vinyl monomers with a copolymerizable monomer having a carboxyl or sulfo group (sulfonic acid group) or a salt thereof, water-soluble acrylic polymers, polyalkylene oxides, water-soluble polyesters and water-soluble polyamides.

The polyvinyl alcohol mentioned above includes completely hydrolyzed (saponified) polyvinyl alcohol, partially hydrolyzed (saponified) polyvinyl alcohol, etc. and polyvinyl alcohol derivatives (e.g. partially acetalized polyvinyl alcohol, acrylic-modified polyvinyl alcohol, etc.), among others. The polyvinyl alcohol may contain ethylene units introduced by copolymerization. The polyvinyl ether includes poly(vinyl methyl ether), poly(vinyl ethyl ether), poly(vinyl propyl ether), poly(vinyl isopropyl ether), poly (vinyl butyl ether), poly(vinyl isobutyl ether) and so on.

The copolymer of a vinyl monomer with a copolymerizable monomer having a carboxyl or sulfo group or a salt thereof includes copolymers of vinyl monomers, e.g. vinyl acetate, vinylpyrrolidone, vinyl alkyl ethers or styrene, with an α,β-ethylenically unsaturated carboxylic acid or its acid anhydride, e.g. (meth)acrylic acid, maleicanhydride, maleic acid or crotonic acid, or an α,β-ethylenically unsaturated sulfonic acid such as ethylenesulfonic acid or a derivative thereof. If required, these copolymers may contain a unit of other copolymerizable monomers such as esters of (meth) acrylic acid. Where the α,β-ethylenically unsaturated carboxylic acid or acid anhydride thereof is a polycarboxylic acid or its acid anhydride, it can be in the form of a hemi- or half-ester with an alcohol or a diester with an alcohol or alcohols within the extent not affecting water solubility. Moreover, the vinyl monomer and copolymerizable monomer for use in the preparation of a copolymer may respectively be one species or a mixture of two or more species.

As examples of such copolymers, there may be mentioned vinyl acetate-maleic acid copolymer, vinyl acetate-crotonic acid copolymer, vinyl acetate-acrylic acid copolymer, vinyl alcohol-maleic acid copolymer, vinyl alcohol-ethylenesulfonic acid copolymer, vinyl alcohol-(meth) acrylic acid copolymer, vinyl methyl ether-maleic acid copolymer, vinyl ethyl ether-maleic acid copolymer, vinyl isobutyl ether-maleic acid copolymer, styrene-(meth)acrylic acid copolymer, styrene-maleic acid copolymer, styrene-crotonic acid copolymer and so on.

The water-soluble acrylic polymer includes, among others, acrylic resins solubilized with (meth)acrylic acid or a salt thereof, such as polyacrylic acid or its salts (e.g. sodium polyacrylate, ammonium polyacrylate, etc.), polymethacrylic acid or its salts, copolymers of (meth)acrylic acid alkyl esters such as methyl methacrylate, butyl acrylate, etc. with (meth)acrylic acid, partially hydrolyzed polyacrylic esters, partially hydrolyzed polyacrylic ester copolymers, polyacrylamide and so on.

The polyalkylene oxide includes polyethylene oxide (polyethylene glycol), polypropylene oxide (polypropylene glycol), ethylene oxide-propylene oxide copolymer and so on. The water-soluble polypropylene oxide is generally available in the molecular weight range not over 1,000. The hydroxyl groups of such polyalkylene oxide may be blocked with a terminal blocking agent such as an organic carboxylic acid.

The water-soluble polyester includes (1) polyesters obtainable by using at least polyethylene glycol as a glycol component, (2) polyesters prepared by using a polycarboxylic acid containing at least 3 carboxyl groups or a dicarboxylic acid having a sulfo group, such as sulfoisophthalic acid, as a part or the whole of the carboxylic acid component, with the residual free carboxyl or sulfo groups neutralized with an alkali metal, e.g. sodium or potassium, ammonia or an amine, and (3) combinations of (1) and (2), namely, polyesters obtainable by using at least polyethylene glycol and a polycarboxylic acid containing 3 or more carboxyl groups or a sulfo-containing dicarboxylic acid. As to the polyethylene glycol, a polyethylene glycol having a molecular weight of, for example, about 200 to 5,000 may be used for imparting a high degree of water solubility.

The water-soluble polyamide includes (4) polyamides obtainable by reacting a diamine having a polyethylene glycol unit, as the diamine component, with a dicarboxylic acid such as adipic acid, sebacic acid or the like [Japanese Patent Application Laid-open No. 219281/1985 (JP-A-60-219281)], (5) polyamides obtainable by reacting diamines having tertiary amino groups (e.g. aminoethylpiperazine, bisaminopropylpiperazine, etc.) with a dicarboxylic acid [Japanese Patent Application Laid-open No. 219281/1985 (JP-A-60-219281)] and (6) polyamides synthesized by using sulfoisophthalic acid or a salt thereof as the dicarboxylic acid component and introducing a sulfonate salt-forming group [Japanese Patent Publication No. 8838/1982 (JP-B-57-8838)], among others. In the preparation of such a polyamide, a lactam compound such as ε-caprolactam can be used in conjunction. The molecular weight of the polyethylene glycol unit may be approximately 200 to 5,000 in order that a high degree of water solubility may be insured.

For enhanced wet-disintegratability, the solubility of the water-soluble polymer in water at 20° C. may be in the range of 5 weight % to infinity, preferably 30 weight % to infinity, more preferably 50 weight % to infinity, and practically in the range of 80 weight % to infinity. Referring to the water-soluble polymer with carboxyl or sulfo groups introduced, its acid value may for example be about 30 to 300.

The preferred polymers, among the water-soluble polymers mentioned above, are natural polysaccharides, modified starches, starch derivatives, cellulose derivatives, vinyl polymers such as polyvinyl alcohol, polyvinylpyrrolidone, polyvinyl ether, etc., acrylic polymers, polyalkylene oxides, polyesters and polyamides. The water-soluble polymer which is particularly desirable from commercial points of view includes natural polysaccharides such as gum arabic, salts of alginic acid, etc., modified starches and starch derivatives such as soluble starch, cellulose derivatives such as carboxymethylcellulose and its salt, hydroxyethylcellulose, hydroxypropylcellulose, cellulose acetate having an average degree of acetylation within the range of about 0.3 to 1, methylcellulose, ethylcellulose, etc., polyvinyl alcohol, polyvinylpyrrolidone, polyvinyl ether, vinyl alkyl ether-maleic acid copolymer, acrylic polymers, polyethylene oxide, polyesters and polyamides.

The molecular weight of the water-soluble polymer can be selected according to the type of water-soluble polymer within the range not interfering with wrapping efficiency in wrapping operation and adhesive power. Thus, the natural polysaccharide preferably shows a viscosity of about 2 to 500 cps and particularly about 5 to 300 cps, as measured at 10% concentration in water. In the case of the modified starches or starch derivatives, the viscosity of a 10% aqueous solution is about 2 to 100 cps, and preferably about 5 to 50 cps. Among the cellulose derivatives, the preferred carboxymethylcellulose and its salt include those compounds having a viscosity of 10 to 500 cps, preferably 20 to 250 cps as measured at 4% concentration in water, while many other cellulose derivatives show viscosities in the range of 5 to 500 cps, preferably 10 to 300 cps, as measured at 10% concentration in water. The polyvinyl alcohol preferably has a saponification degree of not less than 85% and a viscosity, as measured at 4% concentration in water, of 1 to 100 cps, and preferably 3 to 50 cps. As to polyvinylpyrrolidone, polyvinyl ether, vinyl alkyl ether-maleic acid copolymer, acrylic polymers, polyethylene oxide, polyesters and polyamides, those compounds showing viscosities in the range of 1 to 500 cps, preferably 2 to 200 cps and more preferably 5 to 100 cps, as measured for 10% aqueous solutions or dispersions can be employed with advantage. If the solution viscosity is too low, the filter firmness or rigidity is sacrificed to adversely affect the efficiency of wrapping with a wrapping paper and cutting. If the solution viscosity is too high, the workability is adversely affected. The degree of carboxymethylation of carboxymethylcellulose is not critical but may, for example, be about 0.5 to 2.0.

In order that it may not detract from smoking quality and safety, the water-soluble polymer should be nontoxic, tasteless and odorless. Moreover, in consideration of the ease of wrapping, the water-soluble polymer is preferably of low hygroscopicity. From the standpoint of the aesthetic quality of the filter, the hue of the water-soluble polymer is preferably colorless, clear or white.

When the water-soluble polymer is used in the form of an aqueous solution or dispersion, it may happen, depending on the amount of the aqueous solvent used, that the strength and firmness of the filter rod are seriously sacrificed and even that not only the workability of wrapping of the tow with a wrapping paper but also that of cutting the rod into filter tips is remarkably impaired. Particularly where an aqueous solution of the water-soluble polymer is applied to the tow by dipping, the strength and firmness of the tow are considerably decreased. Therefore, where the water-soluble polymer is used in the form of an aqueous solution or dispersion, it is advantageous to reduce the amount of water added to the tow.

On the other hand, a hot-melt adhesive polymer (water-soluble hot-melt adhesive) which develops an adhesive power on melting-solidification is a solventless adhesive and, therefore, has nothing to do with the above troubles. The water-soluble polymer of this type (water-soluble hot-melt adhesive) includes those polymers showing hot-melt adhesiveness, among the polymers mentioned hereinbefore, as represented by 10 polyvinyl alcohol, polyalkylene oxides, polyamides, polyesters and acrylic polymers.

These water-soluble polymers can be used alone or in combination. By way of illustration, a polyvinyl alcohol type hot-melt adhesive may comprise a polyvinyl alcohol having a degree of polymerization not exceeding 1,000 (e.g. 100 to 700) and a saponification degree of not more than 80 mol % (e.g. 20 to 60 mol %), a high-molecular-weight polyethylene glycol having an average degree of polymerization not less than 150 and a low-molecular weight polyethylene glycol having an average degree of polymerization not exceeding 10 [cf. Japanese Patent Application Laid-open No. 65465/1993 (JP-A-5-65465)].

The hot-melt adhesive polyalkylene oxides may have molecular weights in the range of 3,000 to 100,000 and preferably about 5,000 to 50,000.

The water-soluble polymer described above is solid at room temperature and, irrespective of whether it has hot-melt adhesiveness or not, its melting point may for example be about 50° to 200° C., preferably about 70° to 170° C., and more preferably about 80° to 150° C. The recommendable melting point of the water-soluble polymer is about 50° to 150° C. If the melting point of the water-soluble polymer is below 50° C., the polymer tends to soften or melt during smoking. On the other hand, if it is over 200° C., the cellulose ester fiber may be damaged in the melt-bonding process. In order to insure an effective development of adhesive power on heat melting, the decomposition point of the water-soluble polymer is generally not less than 200° C.

The melt viscosity of the water-soluble hot melt adhesive polymer at 150° C. is about 100 to 100,000 cps, preferably about 150° to 75,000 cps, and more preferably about 200 to 50,000 cps. The softening point of the water-soluble hot melt adhesive polymer may for example be about 50° to 200° C. and preferably about 75° to 150° C.

The hot-melt adhesive water-soluble polymer is generally used in a particulate form. The particle size of such a particulate water-soluble polymer can be liberally selected within the range providing for effective development of adhesive power with respect to cellulose ester fiber and not interfering with the wrapping operation. Thus, the mean particle diameter may for example be about 10 to 500 μm, preferably about 30 to 300 μm, and more preferably about 50 to 200 μm. If the mean particle diameter is less than 10 μm, the amount of the water-soluble polymer scattered in the course of wrapping will be increased and because of the difficulty of recoveries, the yield is decreased. Moreover, the wrapping efficiency may be adversely affected. On the other hand, if the mean particle diameter is over 500 μm, the water-soluble polymer cannot be utilized for the effective bonding of cellulose ester fiber.

The amount of the water-soluble polymer can be selected according to the type and mode of use of the polymer and the characteristics of cellulose ester fiber and may for example be about 0.5 to 30 parts by weight, preferably about 1 to 20 parts by weight, and for still better results, about 1 to 17 parts by weight based on 100 parts by weight of the cellulose ester tow. If the proportion of the water-soluble polymer is less than 0.5 part by weight, the polymer cannot exert a sufficient effect as a binder on the cellulose acetate fiber so that the firmness or rigidity (hardness) required of a filter may not be obtained. On the other hand, if the amount of the water-soluble polymer exceeds 30 parts by weight, both smoking quality and wrapping performance tend to be adversely affected and the wrapping paper is liable to develop wrinkles associated with the water-soluble resin.

Where the water-soluble polymer is used in the form of an aqueous solution or dispersion, the amount of the polymer on a solids basis is generally about 0.5 to 20 parts by weight, preferably about 1 to 10 parts by weight, and more preferably about 1 to 5 parts by weight, based on 100 parts by weight of the cellulose ester tow.

Where the water-soluble polymer is used in a particulate form or as a melt, the amount of the polymer is generally about 3 to 25 parts by weight, preferably about 5 to 20 parts by weight, and for still better results, about 5 to 17 parts by weight, based on 100 parts by weight of cellulose ester fiber tow.

The water-soluble polymer can be used in combination with a water-insoluble (non-water-soluble) polymer within the range not adversely affecting the disintegratability of the filter. Thus, when a binder made exclusively of the water-soluble polymer is used, fairly rapid disintegration occurs on contact with water but if the filter is wetted by rain water, for instance, it may deform easily. When the water-soluble polymer and a water-insoluble polymer are used in combination, the shape of the filter is well retained without causing any appreciable decrease in water-disintegratability.

The water-insoluble polymer may be used in the form of a solution or dispersion but when the water-insoluble polymer is used in such a form, the water-disintegratability tends to decrease even at a low addition level. Moreover, when a fibrous water-insoluble polymer is employed, it interlaces with cellulose ester fiber three-dimensionally to increase the number of bonding sites (intersection sites) and, hence, tends to decrease water-disintegratability. On the other hand, when a particulate water-insoluble polymer is employed, the adjacent filaments can be bonded one-dimensionally as point contact so that water-disintegratability is not much affected.

Therefore, as the water-insoluble polymer, a particulate adhesive polymer, particularly a particulate hot-melt adhesive polymer, can be employed with greater advantage. Examples of such non-water-soluble polymer are a variety of polymers which do not adversely affect the flavor, aroma and palatability of tobacco smoke, typically polyolefins (e.g. polyethylene, polypropylene, ethylene-propylene copolymer, etc.), polyvinyl acetate, copolymers of ethylene with vinyl monomers (e.g. ethylene-vinyl acetate copolymer, ethylene-ethyl acrylate copolymer, etc.), acrylic resin, polyesters, polyamides, and so on.

The proportion of the non-water-soluble polymer relative to 100 parts by weight of cellulose ester fiber tow is generally about 0 to 10 parts by weight, preferably about 0.5 to 8 parts by weight, and more preferably about 1 to 6 parts by weight. If the proportion of the non-water-soluble polymer exceeds 10 parts by weight, the water-disintegratability of the filter tends to decrease. The ratio of the water-soluble polymer to the non-soluble polymer can be selected within the range not adversely affecting the water-disintegratability of the filter and may for example be generally about 60–99/40–1 (w/w) and preferably about 70–100/30–5 (w/w).

To the water-soluble polymer and water-insoluble polymer mentioned above, there may be added a variety of additives such as antioxidants and other stabilizers, fillers, plasticizers, preservatives, antifungal agents and so on.

The tobacco filter of the present invention may be incorporated with an additive for improving the aroma, taste and palatability of tobacco smoke by selective removal of an component from tobacco smoke. Typical examples of such additive include absorbers such as an activated carbon or charcoal, a zeolite, etc.

The tobacco filter of this invention can be manufactured by wrapping a tow comprising the cellulose ester fiber (fibrous filtering material) and a water-soluble polymer in wrapping paper to prepare a cylindrical rod as a filter element. The filter rod may be produced by wrapping a tow of cellulose ester fiber to which the water-soluble polymer has been previously applied but the standard practice may comprise depositing the water-soluble polymer on the fiber tow and wrapping the treated tow in wrapping paper. The water-soluble polymer is preferably added to a ribbon or sheet of the tow which may be about 25 to 100 mm (preferably 50 to 100 mm) wide, particularly a flat tow prepared by opening or spreading out the ribbon or sheet to a width of about 100 to 500 mm (preferably 150 to 400 mm). When the tow in the shape of a ribbon or flat ribbon is employed, it is not only possible to achieve a uniform deposition or distribution of the water-soluble polymer but the amount of the water-soluble polymer necessary for bonding the fiber can be decreased, with the result that even when the water-soluble polymer is used in the form of a solution, the required amount of the solvent can be decreased.

The water-soluble polymer can be used not only in the form of a solution or dispersion in water or an organic solvent but also in a particulate form. When used in the form of a solution or dispersion, the water-soluble polymer is generally used as dissolved or dispersed in water or an aqueous solvent. The concentration of the water-soluble polymer in such a solution and the viscosity of the solution can be selected according to the type of water-soluble polymer within the range not adversely affecting the wrapping operation and filter productivity. For example, the concentration may be generally about 5 to 70 weight % and preferably about 10 to 50 weight %, while the solution viscosity at 25° C. may be generally about 5 to 1,000 cps, preferably about 10 to 750 cps, and more preferably about 25 to 500 cps.

In the preparation of a solution or dispersion of the water-soluble polymer, water and/or a water-miscible organic solvent can be employed. The water-miscible organic solvent includes, among others, various alcohols such as methanol, ethanol, isopropyl alcohol, butanol, t-butanol, etc.; polyhydric alcohols such as 1,2-propanediol, 1,3-propanediol, ethylene glycol, diethylene glycol, glycerol, 1,2-butanediol, 1,3-butanediol, 1,4-butanediol, 2,3-butanediol, etc.; ethers such as cellosolves, dioxane, tetrahydrofuran, etc.; and mixtures of such solvents.

There is no particular restriction on the mode of addition of the water-soluble polymer to the tow, only provided that the water-soluble polymer can be deposited on the tow of cellulose ester fiber, and a suitable method can be selected according to the form of water-soluble polymer. Thus, when the water-soluble polymer is used in the form of a solution, dispersion or emulsion, the polymer can be applied or deposited on the tow, preferably the opened or spread-out tow or ribbon, of cellulose ester fiber by, for example, spraying, e.g. with a spray gun, or coating. The water-soluble polymer in a liquid form is usually applied to both sides of such a ribbon of tow.

Where a solution or dispersion of the water-soluble polymer is employed, the amount of the solvent, water in particular, relative to the tow of cellulose ester fiber exerts a significant influence on filter productivity inclusive of the efficiency of tow wrapping. Thus, when the amount of the solvent (particularly water) applied to the tow is large, both the strength and firmness or rigidity of the filter are considerably decreased so that the wrapping and cutting become difficult. Furthermore, it takes time for the filter to develop its required strength and a great deal of energy is needed for drying. On the other hand, if the amount of the solvent (particularly water) is too small, it is difficult to integrate the cellulose ester fiber. Therefore, the proportion of water based on 100 parts by weight of the tow should be not greater than 25 parts by weight, preferably about 0.5 to 20 parts by weight, more preferably about 1 to 15 parts by weight, and particularly about 1 to 10 parts by weight. By controlling the amount of water with respect to the tow within the above range, the filter rod (tobacco filter) can be smoothly manufactured even at a high tow wrapping rate of about 200 to 800 m/min., and preferably about 300 to 800 m/min.

Where a solution or dispersion of the water-soluble polymer is employed, the tobacco filter can be easily manufactured by mere addition of a dryer for removing water during or after the wrapping stage to the existing tobacco filter production equipment.

When the water-soluble polymer in a particulate form is employed, the above-mentioned problems associated with the solvent are not encountered. The solventless type solid water-soluble polymer, preferably a hot-melt adhesive water-soluble polymer, can be added to the tow by, for example, (1) a process which comprises applying a molten or melt polymer to the tow by spraying with a spray gun or coating or (2) a process which comprises dusting a powder of the water-soluble polymer over the tow. For the addition of a particulate water-soluble polymer, a wet process can be used in combination with such a process. For example, the solid water-soluble polymer can be added to the tow by (3) a process which comprises adding a powder of the water-soluble polymer to the tow and, then, adding a predetermined amount of the solvent, e.g. water or an organic solvent so as to let the polymer adhere to the tow or (4) a process which comprises adding a predetermined amount of the solvent, e.g. water or an organic solvent, to the tow so as to wet it and, then, adding the powder of water-soluble polymer to let it adhere to the fiber.

Among preferred processes is a process which comprises adding a particulate water-soluble polymer uniformly to the tow (particularly an opened tow). The water-soluble polymer added to the tow in this manner is utilized for the bonding of cellulose ester fiber as it is melted by a heater installed upstreams—downstreams of the wrapping stage. For the addition of a particulate water-soluble polymer, the device for addition of activated charcoal powder which is available on the existing production equipment for charcoal filters, for instance, can be utilized.

Where the solid water-soluble polymer is employed, the tobacco filter can be easily manufactured by mere addition of a heating device or unit for melting the polymer and a cooling device or unit for solidifying the polymer melt to the existing tobacco filter production equipment.

In the usual production of tobacco filters, the tow is wrapped generally at a high speed of 200 to 800 m/min., preferably 300 to 600 m/min. Therefore, the drying for removal of the solvent and the heat-melting of the water-soluble polymer should be preferably effected by a means which is capable of heating the entire filter rod uniformly in the shortest possible time so that the firmness or hardness and other physical properties of the filter can be uniformly controlled without detracting from productivity. Induction heating can be mentioned as an example of such heating technology.

Incidentally, in order that the wet-disintegratability will not be adversely affected, a water-soluble adhesive similar to the above is preferably employed for gluing the circumferential edge of wrapping paper constituting the tobacco filter (filter rod) and covering the cylindrical tow, and for gluing the edge of the wrapping paper covering the filter plug or tip, prepared by cutting the filter to a predetermined length, and the cylindrical tobacco portion.

The following examples and comparison examples are intended to describe this invention in further detail and should by no means be construed as defining the scope of the invention.

EXAMPLES

Example 1

A 43,000-denier crimped (26 crimps/25 mm) cellulose acetate tow constituted by bundling 4-denier monofilaments of Y-section was opened to a width of 25 cm. This 43,000-denier tow was composed of 10,750 monofilaments (4 deniers each). Then, an aqueous solution of polyvinyl alcohol (degree of saponification=88 mol %, viscosity of 4% aqu. sol.=5 cps), as the water-soluble polymer, was uniformly added in a predetermined amount to the above opened tow. The tow was then fed to a wrapping machine where it was wrapped up in wrapping paper. After the excess moisture was removed by heating, the tow was cut to 25 mm in length to provide tobacco filter tips.

Examples 2 to 5

Tobacco filter tips were prepared in the same manner as Example 1 except that, in lieu of the polyvinyl alcohol, carboxymethylcellulose sodium (degree of carboxymethylation=0.85, viscosity of 4% aqu. sol.=30 cps, Example 2), soluble starch (viscosity of 10% aqu. sol.=10 cps, Example 3), methyl vinyl ether-maleic acid copolymer (viscosity of 10% aqu. sol.=8 cps, Example 4) and hydroxypropylcellulose (viscosity of 10% aqu. sol.=40 cps, Example 5) were respectively used in the form of an aqueous solution as the water-soluble or -dispersible polymer.

Example 6

By use of a charcoal filter wrapping machine, to a 43,000-denier (total) crimped (26 crimps/25 mm) cellulose acetate tow composed of 4-denier Y-section monofilaments was added 20 weight % of a mixed solvent of 1,2-propanediol and water (1:1, w/w) followed by addition of 5 weight %, based on the tow, of powdery polyvinyl alcohol (degree of saponification=88 mol %, viscosity of 4% aqu. sol.=5 cps, 60 mesh pass, particle size distribution=10 to 200μ, mean particle size =70μ). The tow was then fed to the charcoal filter wrapping machine where it was wrapped in wrapping paper and cut to 25 mm in length to provide tobacco filter tips.

Example 7

Tobacco filter tips were prepared in the same manner as Example 6 except that powdery carboxymethylcellulose sodium (degree of carboxymethylation=0.85, viscosity of 4% aq. sol.=30 cps, particle size distribution=10 to 200 μm, mean particle size=75 μm) was used as the water-soluble polymer.

Example 8

A 43,000-denier crimped (26 crimps/25 mm) cellulose acetate tow composed of 4-denier Y-section monofilaments was spread out to a width of 25 cm and a solution of soluble starch (viscosity of 10% aq. sol.=10 cps) in a mixed solvent of 1,2-propanediol and water was uniformly added in a predetermined amount to the opened tow. The tow was then fed to a wrapping machine where it was wrapped up in wrapping paper and cut to 25 mm in length to provide tobacco filter tips.

Examples 9 and 10

Tobacco filter tips were produced in the same manner as Example 8 except that, in lieu of the soluble starch, methyl vinyl ether-maleic acid copolymer (viscosity of 10% aq. sol.=8 cps, Example 9) and hydroxypropylcellulose (viscosity of 10% aq. sol.=40 cps, Example 10) were respectively used as the water-soluble polymer.

Comparative Examples 1 to 3

Tobacco filter tips were manufactured in the same manner as Example 1 except that, as the binder, triacetin (Comparative Example 1), triethylene glycol diacetate (Comparative Example 2) and triethylene glycol propionate (Comparative Example 3), all of which are plasticizers for cellulose acetate, were respectively used.

The filter firmness and water-disintegratability of the tobacco filter tips obtained in the above Examples and Comparative Examples were evaluated. The results are shown in Table 1. Test samples were subjected to the tests after about 24 hours of conditioning in an environment controlled at 20° C. and 65% R.H.

[Filter Firmness]

A dead weight measuring 12 mm in diameter and weighing 300 g was placed on a 90 mm-long filter specimen and the amount of depression was determined after 10 seconds and scored with 0.1 mm being taken as 1. The practically acceptable filter firmness limit according to the above evaluation method is 10.0 or less.

[In-Water Disintegratability Test]

A 25 mm-long filter tip specimen was placed in beaker containing 500 ml of water and stirred in such a manner that the height in the center of the vortex would be equal to ¾ of the maximum height of liquid level. After 10 minutes, the filter was visually inspected and rated for disintegratability according to the following criteria.

Excellent: Rapid flocculent disintegration

Good: Local flocculent disintegration

Poor: No disintegration; original shape retained

TABLE

| | polymer content (% by weight) | water content (% by weight) | firm-ness | disintegratability in water |
|---|---|---|---|---|
| Example 1 | 2 | 15 | 8 | Excellent |
| Example 2 | 5 | 20 | 9 | Excellent |
| Example 3 | 3 | 15 | 8 | Excellent |
| Example 4 | 2 | 5 | 7 | Excellent |
| Example 5 | 4 | 10 | 7 | Excellent |
| Example 6 | 5 | 10 | 9 | Excellent |
| Example 7 | 5 | 10 | 9 | Excellent |
| Example 8 | 5 | 15 | 8 | Excellent |
| Example 9 | 2 | 5 | 7 | Excellent |
| Example 10 | 4 | 10 | 7 | Excellent |
| Com. Ex. 1 | 8 | — | 6 | Poor |
| Com. Ex. 2 | 6.8 | — | 7 | Poor |
| Com. Ex. 3 | 9.0 | — | 7 | Poor |

Example 11

A 35,000-denier cellulose acetate tow composed of 5-denier monofilaments was opened to a width of about 25 cm and a powder of polyalkylene oxide type water-soluble hot-melt adhesive resin (Paogen PP-15, Dai-ichi Kogyo Seiyaku Co., Ltd., Japan; m.p.=55° C., particle size distribution=8 to 200 μm, mean particle size=75 μm) was uniformly dusted over the tow at an addition level of 7 weight % (based on the tow) as of the time of wrapping. The tow was then drawn through a Teflon tube with an inner diameter of 8 mm and the water-soluble hot-melt adhesive resin in the filter was melted by heating for 120 minutes in an oven at 120° C. After cooling and solidification, the tow was cut to 90 mm in length to provide tobacco filter tips.

The firmness of the resultant filter tips was 9.8, and when placed in water, the tips were rapidly disintegrated as a whole into a flocculent state. No change was found in smoking quality.

Example 12

Tobacco filter tips were prepared in the same manner as Example 11 except that, in lieu of the water-soluble hot-melt adhesive resin, a powder of polyvinyl alcohol type water-soluble hot-melt adhesive resin (HM-501, The Nippon Synthetic Chemical Industry Co., Ltd., Japan; m.p.=77° C., particle size range=8–200 μm, mean particle size=80 μm) was used. The firmness of the resultant filter tips was 8.8, and when placed in water, the tips were rapidly disintegrated as a whole into a flocculent state. No change was found in smoking quality.

Example 13

Tobacco filter tips were prepared in the same manner as Example 11 except that, in lieu of the water-soluble hot-melt adhesive resin, a powder of polyvinyl alcohol type water-soluble hot-melt adhesive resin (HM-602, The Nippon Synthetic Chemical Industry Co., Ltd., Japan; m.p.=77° C., mean particle size=80 μm) was used. The firmness of the resultant filter tips was 7.8, and when placed in water, the tips were rapidly disintegrated as a whole into a flocculent state. No change was found in smoking quality.

Examples 14 to 16

Tobacco filter tips were prepared in the same manner as Example 11 except that the heating time in the oven was changed to 2 minutes (Example 14), 10 minutes (Example 15) or 30 minutes (Example 16), respectively. The firmness of the resultant filter tips of Examples was not greater than 10. Namely, the firmness of the tips in Example 14 was 6.6, the firmness of the tips in Example 15 was 6.0, and the tips of Example 16 had a firmness of 9.8. When the filter tips of Examples 14 to 16 were respectively placed in water, the tips were rapidly disintegrated as a whole into a flocculent state. No change was found in smoking quality in each tips obtained in Examples 14 to 16.

Example 17

By use of a powdery charcoal-dusting apparatus of a charcoal-containing filter wrapping machine (KDF2/AC1/AF1, Hauni-Werke Körber & Co., Germany), a 36,000-denier (total) cellulose acetate tow of 3-denier monofilaments was spread out to a width of about 25 cm and the powdery water-soluble hot-melt adhesive resin used in Example 11 was uniformly dusted over the tow at an addition level of 14 weight % (based on the tow) in the wrapping stage. The tow was then fed, at a speed of 400 m/min., to the filter wrapping machine where it was wrapped in wrapping paper and cut to 102 mm in length. The resultant filter was heated for 20 minutes in an oven at 120° C. and cooled to provide a tobacco filter tips.

The firmness of the resultant filter tips was 3.5, and when placed in water, the tips were rapidly disintegrated as a whole into a flocculent state. No change was found in smoking quality.

Examples 18 to 20

Tobacco filter tips were prepared in the same manner as Example 17 except that the heating time was changed to 2 minutes (Example 18), 10 minutes (Example 19) or 30 minutes (Example 20), respectively. The firmness of the resultant filter tips was not greater than 10. Namely, the firmness of the tips of Example 18 was 5.5, the tips of Example 19 showed a firmness of 4.4, and the tips of Example 20 had a firmness of 5.2. When the filter tips of Examples 18 to 20 were respectively placed in water, the tips were rapidly disintegrated as a whole into a flocculent state. No change was found in smoking quality in each tips obtained in Examples 18 to 20.

Examples 21 to 23

Tobacco filter tips were prepared in the same manner as Example 17 except that the heating temperature was changed to 60° C. (Example 21), 80° C. (Example 22) or 100° C. (Example 23), respectively. Each filter tips of Examples had a firmness of not greater than 10, i.e. the tips of Examples 21 and 22 showed a firmness of 5.1 and the tips of Example 23 had 5.5. When the filter tips of Examples 21 to 23 were respectively placed in water, the tips were rapidly disintegrated as a whole into a flocculent state. No change was found in smoking quality in each tips obtained in Examples 21 to 23.

Example 24

Tobacco filter tips were prepared in the same manner as in Example 11 except that 10% by weight based on the tow of the powdery water-soluble hot-melt adhesive resin used in Example 11 and 5% by weight based on the tow of powdery ethylene-vinyl acetate copolymer (Daikalac S-1101S, Daido kasei Kogyo Co., Ltd., Japan; m.p.=105° C., mean particle size=80 μm), as a non-water-soluble hot-melt adhesive resin, were uniformly dusted over the tow.

The firmness of the resultant filter tips was 5.9, and when placed in water, the tips were rapidly disintegrated as a whole into a flocculent state. No change was found in smoking quality.

Comparative Example 4

Tobacco filter tips were prepared in the same manner as in Example 11 except that a powdery ethylene-vinyl acetate copolymer (Daikalac S-1101S, Daido kasei Kogyo Co., Ltd., Japan; m.p.=105° C., mean particle size=80 μm) as a non-water-soluble hot-melt adhesive resin was used instead of the water-soluble hot-melt adhesive resin used in Example 11.

The firmness of the resultant filter tips was 5.9, and when placed in water, the tips were not disintegrated at, all and the original shape was retained.

Comparative Example 5

Tobacco filter tips were prepared in the same manner as in Example 11 without using the water-soluble hot-melt adhesive resin in Example 11.

The resultant filter tips did not developed the firmness and showed a firmness of not less than 25.0. While, when placed in water, the tips were rapidly disintegrated as a whole into a flocculent state.

What is claimed is:

1. A method for producing a tobacco filter which comprises a combination of steps of adding or depositing a particulate hot-melt adhesive polymer to a tow of cellulose ester fiber; and processing the hot-melt adhesive polymer-containing tow into a filter rod, wherein the hot-melt adhesive polymer comprises a water-soluble polymer and a non-water-soluble polymer.

2. A method for producing a tobacco filter according to claim 1, wherein the particulate hot-melt adhesive water-soluble polymer has a mean particle size diameter of 10 to 500 μm, and is deposited on the cellulose ester fiber.

3. A tobacco filter comprising a tow of cellulose ester fiber, said cellulose ester fiber being bonded by (i) 5 to 20 parts by weight of a particulate hot-melt adhesive water-soluble vinyl polymer, except for a (meth)acrylate, relative to 100 parts by weight of the tow, wherein said water-soluble polymer has a melting point of 50 to 150° C., a melt viscosity of 150 to 75,000 cps at 150° C. and a mean particle diameter of 30 to 300 μm; and (ii) 0.5 to 8 parts by weight of a particulate hot-melt adhesive non-water-soluble polymer relative to 100 parts by weight of the tow;

wherein the ratio of the water-soluble polymer to the non-water-soluble polymer is 60/40 to 99/1.

* * * * *